US008172547B2

(12) United States Patent
Dyer et al.

(10) Patent No.: US 8,172,547 B2
(45) Date of Patent: May 8, 2012

(54) DIELECTRIC BARRIER DISCHARGE PUMP APPARATUS AND METHOD

(75) Inventors: Richard S. Dyer, Maryland Heights, MO (US); Joseph S. Silkey, Florissant, MO (US); Bradley A. Osborne, Manchester, MO (US)

(73) Assignee: The Boeing Company, Chicago, IL (US)

( * ) Notice: Subject to any disclaimer, the term of this patent is extended or adjusted under 35 U.S.C. 154(b) by 1132 days.

(21) Appl. No.: 12/023,697

(22) Filed: Jan. 31, 2008

(65) Prior Publication Data

US 2009/0196765 A1 Aug. 6, 2009

(51) Int. Cl.
*F04B 37/04* (2006.01)

(52) U.S. Cl. ..... 417/76; 417/158; 417/195

(58) Field of Classification Search ..... 417/76, 417/158, 195

See application file for complete search history.

(56) References Cited

U.S. PATENT DOCUMENTS

2007/0241229 A1* 10/2007 Silkey et al. ..... 244/53 A

FOREIGN PATENT DOCUMENTS

WO WO 2007/133239 11/2007
WO WO 2008/016928 2/2008

OTHER PUBLICATIONS

Corke, T. and Post, M. "Overview of Plasma Flow Control: Concepts, Optimization, and Applications," University of Notre Dame, Notre Dame, IN, AIAA-2005-563, 43rd AIAA Aerospace Sciences Meeting and Exhibit, Reno, Nevada, Jan. 10-13, 2005.

Tilmann, C.; Kimmel, R.; Addington, G. and Myatt, James H. "Flow Control Research and Applications at the AFRL's Air Vehicles Directorate," Air Force Research Laboratory, Wright-Patterson AFB, OH, AIAA-2004-2622, 2nd AIAA Flow Control Conference, Portland, Oregon, Jun. 28-1, 2004.

Enloe, C. L.; McLaughlin, Thomas E.; VanDyken, Robert D.; Kachner, K. D.; Jumper, Eric J.; Corke, Thomas C. "Mechanisms and Responses of a Single Dielectric Barrier Plasma Actuator: Plasma Morphology," AIAA Journal 2004, 0001-1452 vol. 42, No. 3, pp. 589-594.

Post, Martiqua L. and Corke, Thomas C. "Separation Control on High Angle of Attack Airfoil Using Plasma Actuators," AIAA Journal 2004, 0001-1452, vol. 42, No. 11, pp. 2177-2184.

Porter, C. O.; Baughn, J. W.; McLaughlin, T. E.; Enloe, C. L.; and Font, G. I. "Plasma Actuator Force Measurements," AIAA Journal 2007, vol. 45, No. 7, 2007.

(Continued)

*Primary Examiner* — Charles Freay
*Assistant Examiner* — Patrick Hamo
(74) *Attorney, Agent, or Firm* — Harness, Dickey & Pierce, P.L.C.

(57) ABSTRACT

A dielectric element barrier discharge pump for accelerating a fluid flow. In one embodiment the pump has a first dielectric layer having a first electrode embedded therein and a second dielectric layer having a second electrode embedded therein. The first and second dielectric layers are further supported apart from one another to form an air gap therebetween. A third electrode is disposed at least partially in the air gap upstream of the first and second electrodes, relative to a direction of flow of the fluid flow. A high voltage supplies a high voltage signal to the third electrode. The electrodes cooperate to generate opposing asymmetric plasma fields in the gap that create an induced air flow within the gap. The induced air flow operates to accelerate the fluid flow as the fluid flow moves through the gap.

17 Claims, 5 Drawing Sheets

OTHER PUBLICATIONS

Roth, J. Reece. University of Tennessee Plasma Sciences Laboratory, Final Report Grant AF F49620-01-1-0425 (ROTH)—"An Investigation of Flow Acceleration and Electromagnetic Absorption Phenomena Induced by Paraelectric and Peristaltic Electrohydrodynamic Effects of the One Atmosphere Uniform Glow Discharge Plasma," Jun. 1, 2001 to Nov. 30, 2003, pp. 1-25.

Santhanakrishnan, Arvind and Jacob, Jamey D. "On Plasma Synthetic Jet Actuators," Dept. of Mechanical Engineering, University of Kentucky, Lexington, Kentucky, AIAA 2006-0317 44th AIAA Aerospace Sciences Meeting and Exhibit, Jan. 9-12, 2006, Reno, NV.

Mittermayer, Marc-André. "Forecasting Intraday Stock Price Trends with Text Mining Techniques," University of Bern, Institute of Information Systems, 0-7695-2056-1/04 © 2004 IEEE, pp. 1-10.

Forte, M. et al. "Optimization of a Dielectric Barrier Discharge Actuator by Stationary and Non-Stationary Measurements of the Induced Flow Velocity: Application to Airflow Control," Experiments in Fluids; Experimental Methods and Their Application to Fluid Flow, Springer, Berlin, Germany, vol. 43, No. 6, pp. 917-928, Aug. 1, 2007, XP-019562220.

* cited by examiner

DIELECTRIC BARRIER DISCHARGE PUMP APPARATUS AND METHOD

FIELD

The present disclosure relates to generally to pumps, and more particularly to a dielectric barrier discharge pump apparatus and method which enables a fluid jet to be generated through the creation of an asymmetric plasma field, and without the need for moving parts typically associated with fluid pumps.

BACKGROUND

The statements in this section merely provide background information related to the present disclosure and may not constitute prior art. In many applications, it would be desirable to be able to accelerate a fluid flow (e.g., an air flow, an exhaust flow, a gas flow, etc.) within a duct or other form of confined area through which the fluid is flowing or to form a fluid jet for expulsion, injection, or mixing of a fluid or for aerodynamic control or propulsive purposes. In some cases, this can be particularly difficult with the use of conventional pumps or like devices. For one, there is the difficulty of physically mounting a pump within a duct or conduit. Another challenge is that the pump may need to be of a physical size that would cause it to significantly obstruct the fluid flow through the duct, or conversely to require the diameter of the duct or conduit to be unacceptably large. Still further, a conventional pump, which may require that it be driven by an electric motor, will typically have a number of moving parts. The presence of a number of moving parts, in the motor or in the pump itself may give rise to required periodic maintenance and/or repair, which may be difficult and time consuming if the pump is mounted within a duct or conduit. Conventional pumps may also be noisy and have an appreciable weight that limits their use in various applications.

SUMMARY

The present disclosure relates to a dielectric barrier discharge apparatus and method that is especially well suited for use as a pump within a duct through which a fluid (e.g., air flow, gas flow, exhaust flow, etc.) is flowing. In one embodiment the apparatus comprises a first dielectric layer having a first electrode embedded therein. A second electrode is disposed at least partially in the air gap, upstream of the first electrode relative to a direction of flow of the fluid flow. A high voltage source supplies a high voltage signal to the second electrode. The electrodes cooperate to generate an asymmetric plasma field in the air gap that creates an induced air flow within the air gap. The induced air flow accelerates the fluid flow as the fluid flow moves through the air gap.

In various embodiments two or more spaced apart dielectric layers are used with each having at least one embedded electrode. An exposed electrode is positioned in the air gap between the dielectric layers. A pair of asymmetric, opposing plasma fields are generated that help to accelerate flow through the air gap.

In one implementation a method is disclosed for forming a fluid flow pump for accelerating a fluid through a duct. The method may comprise:

disposing a first electrode at least partially within a first dielectric layer;

disposing said first dielectric layer within the duct;

disposing a second electrode at least partially within a second dielectric layer;

disposing the second dielectric layer within the duct so as to be in generally facing relation to the first dielectric layer, and such that an air gap is formed between the first and second dielectric layers;

positioning a third electrode within the duct such that the third electrode is located at least partially within the air gap and towards an upstream end of the dielectric layers, relative to a direction of flow of the fluid through the air gap; and electrically exciting the third electrode to cause the third electrode, the first electrode and the second electrode to cooperatively generate opposing, asymmetric electrical fields within the air gap, to thus generate an induced flow through the air gap. The induced flow operates to accelerate the fluid as the fluid flows through the air gap.

In various embodiments and implementations, a greater plurality of electrodes may be employed to form a plurality of spaced apart air gaps through which a fluid flow may be accelerated.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
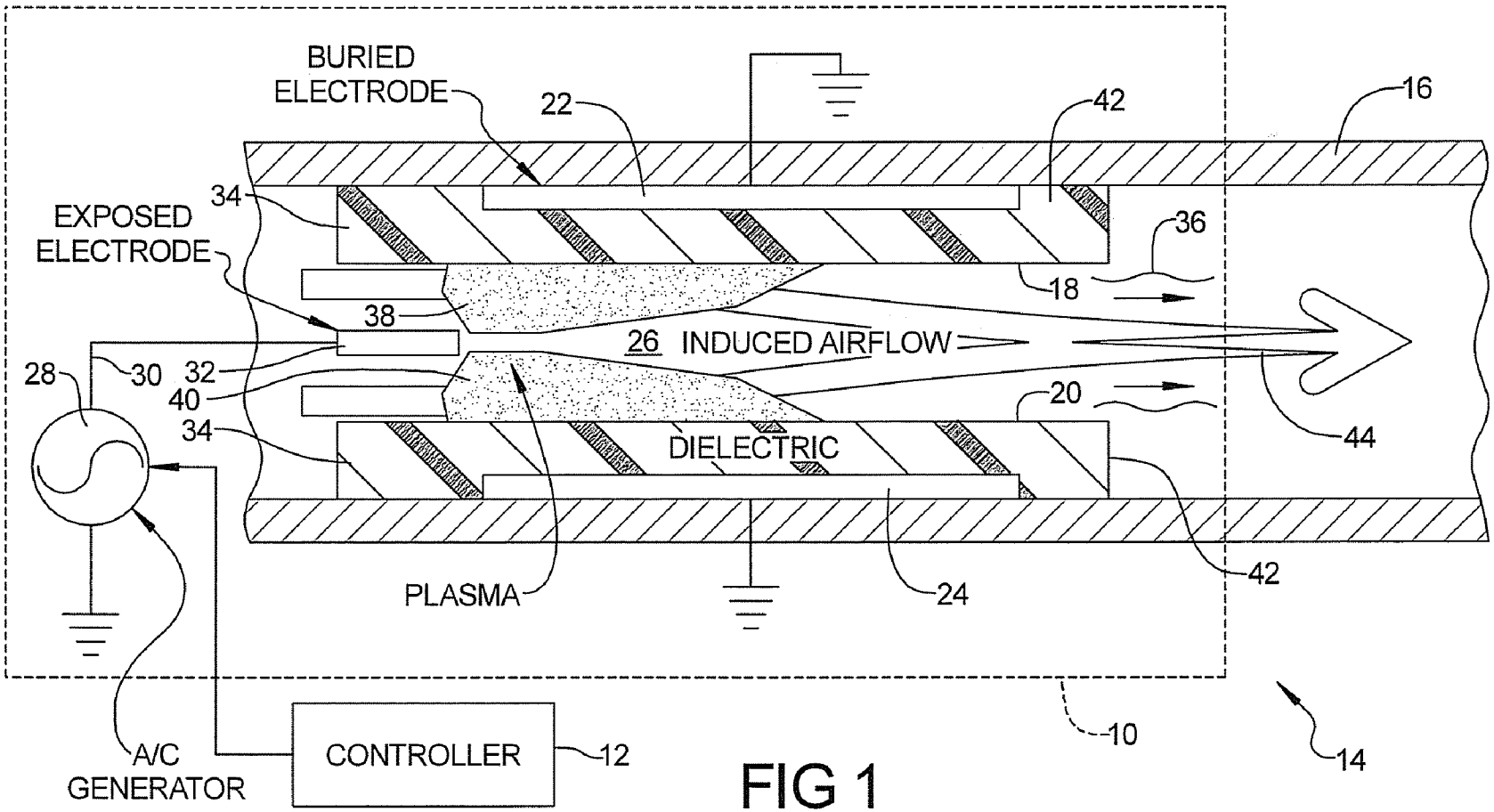
FIG. 1 is a schematic diagram of one embodiment of a fluid flow accelerating apparatus in accordance with the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a fluid flow accelerating apparatus 10 is shown. The use of the apparatus in connection with a controller 12 forms a fluid flow accelerating system 14. The apparatus 10 may be positioned within a duct 16, a conduit or within any component or structure where a contained or semi-contained fluid flow exists, and where it is desired to accelerate the fluid flow.

Referring further to FIG. 1, the apparatus 10 includes a first dielectric 18 layer secured to an interior wall of the duct 16, and a second dielectric layer 20 also secured to an interior wall of the duct so as to be in facing (i.e., opposing) relationship. The first dielectric layer 18 includes a first electrode 22 at least substantially embedded within the layer 18. The second dielectric layer 20 includes a second electrode at least substantially embedded within the layer 20. The positioning of the dielectric layers 18 and 20 forms an air gap 26 therebetween. Preferably the air gap 26 spacing is about 0.1 inch-1.0 inch (3 mm-25 mm), although this may also vary depending on the application. The dielectric layers 18 and 20 may also be recessed mounted themselves within the interior surface of the duct 16, or they may be positioned within openings formed in the duct 16 wall. Any mounting arrangement is considered to be within the scope of the present disclosure.

The apparatus 10 further comprises an alternating current (AC) high voltage source 28, which is preferably generating an output of about 1 KVAC-100 KVAC, peak-to-peak, depending on the electrical strength and thickness of the dielectric. The output 30 of the AC voltage source 28 is applied to a third (i.e., non-embedded) electrode 32. The third electrode 32 is supported within the duct 16 in any suitable manner, such as by one or more radially extending struts (not shown). The third electrode 32 is also disposed adjacent upstream ends 34 of the dielectric layers 18 and 20. By "upstream end", it is meant a position that is towards an upstream side of the dielectric layers 18 and 20 when considering the direction of flow of a fluid 36 through the duct 16. In this example, since the fluid 36 is flowing left to right through the duct 16, the upstream end 34 of the dielectric layers 18 and 20 is the left side of the dielectrics layers 18 and 20. While the third electrode 32 is shown in FIG. 1 as being positioned completely within the air gap 26 (i.e., within the area bounded by the dielectric layers 18 and 20), it is possible for the third electrode 32 to be positioned partially exteriorly of the air gap 26, that is, outwardly of the area bounded by the dielectric layers 18 and 20.

The operation of the AC voltage source 28 is controlled by the controller 12. The controller may control the AC voltage source 28 such that the AC voltage source 28 generates high voltage pulses of a desired frequency. The wave form of the high voltage source may be sinusoidal, square wave, sawtooth, or a short duration (nanosecond) pulse, or any combination of these pulses. Any other control scheme may be implemented depending on the particular needs of a given application.

The dielectric layers 18 and 20 are illustrated in FIG. 1 as being of the same thickness and length, although this is not absolutely necessary. Thus, the thickness and length of the dielectric layers 18 and 20 may be varied to suit specific applications. In the illustrated embodiment of FIG. 1, however, the thickness of each dielectric layer 18 and 20 is preferably about 0.01 inch-0.5 inch (0.254 mm-0.127 mm). The length of each dielectric layer 18 and 20 may also vary to meet the needs of a given application, but will in most instances be at least slightly longer than the length of the electrode (22 or 24) that is embedded within it. Just as an example, the length of each electrode 22 and 24 may be about 0.5 inch-3 inch 13 mm-75 mm), and the length of each dielectric layer 18 and 20 may then be between about 1.0 inch-4.0 inch (25.4 mm-101.6 mm). The dielectric layers 18 and 20 may be comprised of TEFLON®, KAPTON®, quartz, sapphire, or any other convenient insulator with good dielectric strength. The electrodes 22 and 24 may be formed from copper, aluminum, or any other material that forms a convenient conductor.

In operation, the AC voltage source 28 applies a high voltage signal on output line 32 that electrically energizes the third electrode 32. This enables the third electrode 32, the first electrode 22 and the second electrode 24 to cooperatively form a pair of asymmetrically accelerated plasma fields 38 and 40. By "asymmetric", it is meant that the strength of the force on the plasma field is greater in the downstream direction as shown, which is indicated by the tapering shape of each field 38 and 40 as the fields extend towards the downstream ends 42 of the dielectric layers 18 and 20. The asymmetric plasma fields 38 and 40 create an induced air flow 44 though the air gap 26. The induced air flow 44 operates to accelerate the flow of the fluid 36 flowing through the duct 16. The fluid 36 may be an exhaust gas, or may be an air flow, or it may comprise virtually any form of ionizable gas.

Figure 1A:
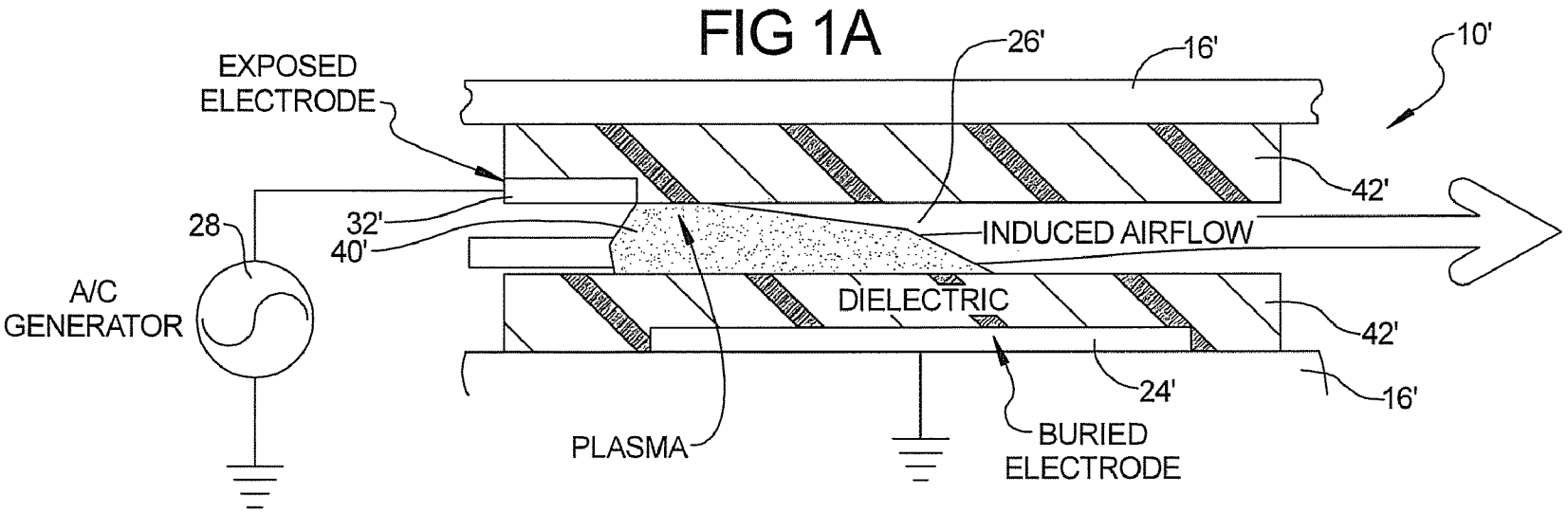
FIG. 1A is a schematic diagram of a different embodiment of the apparatus where only a single embedded electrode is included.
Figure 1B:
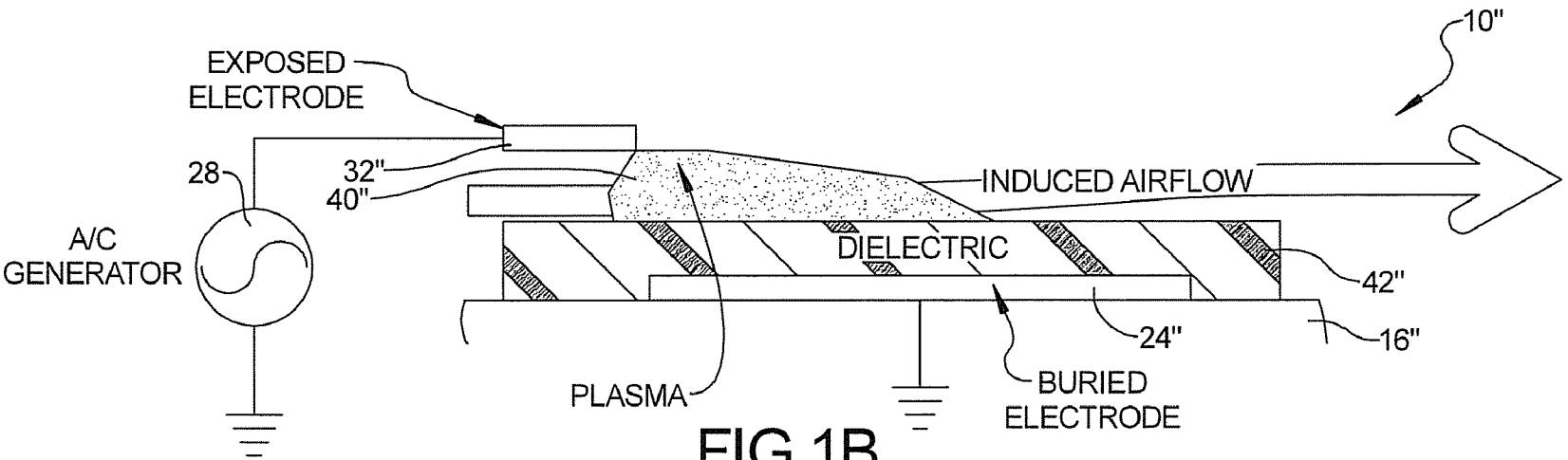
FIG. 1B is a schematic diagram of a different embodiment of the apparatus that is suitable to be used where a complete, fully formed duct is not available.

A number of different embodiments of the apparatus 10 may be constructed using the teachings described above. For example, as shown in FIG. 1A, an apparatus 10' may be constructed that is equivalent to half of the apparatus 10 shown in FIG. 1. Here the exposed electrode 32' is embedded in a dielectric layer 42' that forms, or that fully or partially covers, one of the interior duct walls 16'. FIG. 1B shows another embodiment of an apparatus 10" having an exposed electrode 32", and an electrode 24" embedded in a dielectric layer 42". The apparatus 10" may be configured and used without a fully formed duct. In this example the exposed electrode 32" would need to be supported by some external support or strut to maintain it at the desired distance from dielectric layer 42'.

Figure 2:
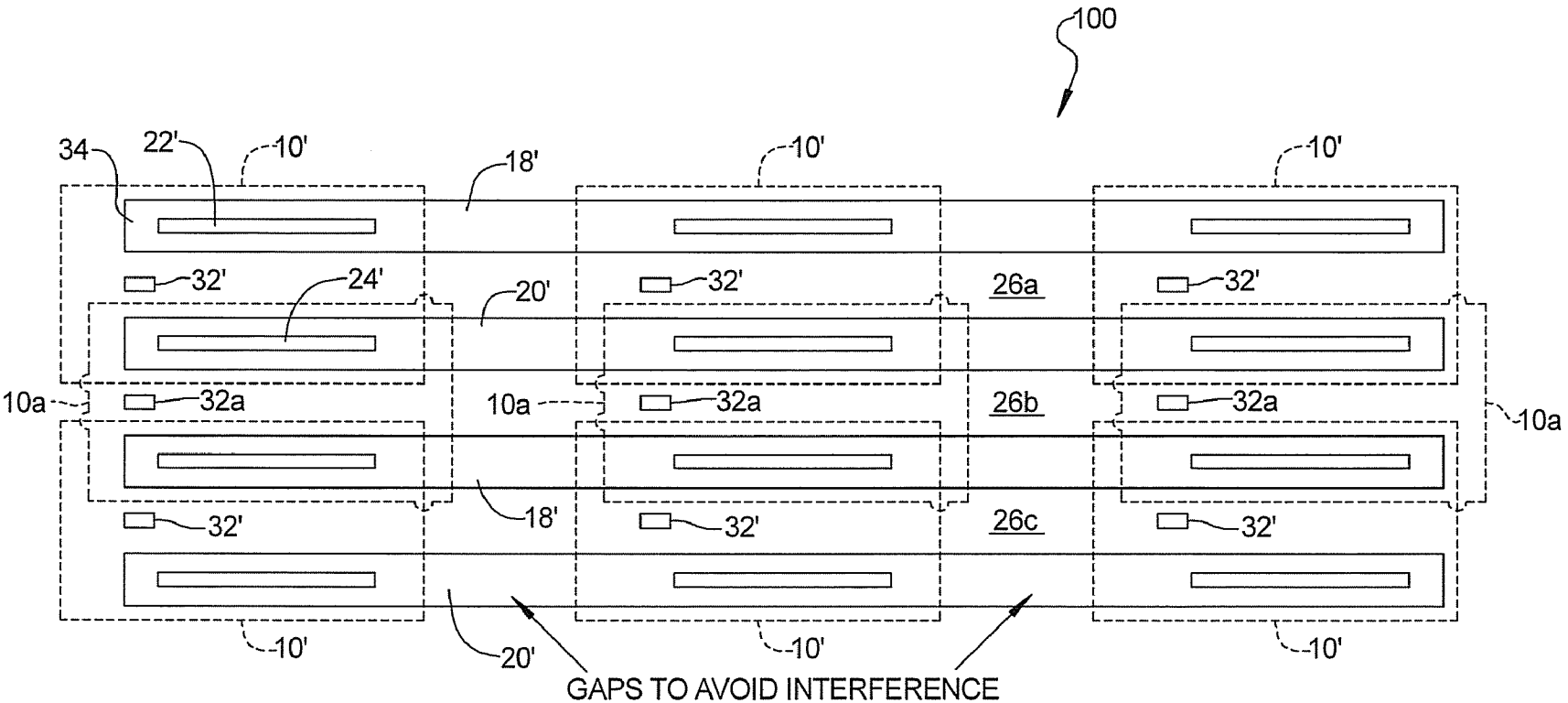
FIG. 2 is a side view of a two-dimensional fluid flow accelerating system using nine ones of the fluid flow accelerating apparatus shown in FIG. 1.

Referring to FIG. 2, a two-dimensional flow accelerating system 100 is shown that employs, for example, a total of nine flow accelerating apparatuses 10' and 10*a*. System 100 forms a three stage, two pump system. Each of the flow accelerating apparatuses 10' is identical in construction to the flow accelerating apparatus 10 shown in FIG. 1 with the exception that each flow accelerating apparatus 10' includes its electrodes 22' and 24' completely embedded within dielectric layers 18' and 20', respectively. Like components in FIGS. 1 and 2 have been designated with the same reference number, but with a prime symbol being used with each number in FIG. 2.

The system 100 in FIG. 2 makes use of the inner two most dielectric layers 20' and 18', and three ones of the electrodes 32*a*, to form the three centrally located apparatuses 10*a*. Otherwise, the electrodes 32*a* are identical in construction to the electrodes 32 and 32'. To avoid cluttering the drawing, the AC voltage source 28 and the output lines that couple the AC voltage source 28 to each of the non-embedded electrodes 32' and 32*a* have been omitted. The controller 12 has also been omitted. The system 100 of FIG. 2 forms three distinct air gaps 26*a*, 26*b* and 26*c* through which a fluid may flow. The dielectric layers 18' and 20' are each of sufficient length to encapsulate the electrodes 22' while allowing gaps between longitudinally adjacent ones of the apparatuses 10' and 10*a* such that the non-embedded electrode (32' or 32*a*) of one apparatus (10' or 10*a*) does not interfere with a longitudinally adjacent apparatus 10' or 10*a*. The apparatuses 10' and 10*a* may be electrically energized sequentially, such as from left to right in the Figure, or in any other desired order.

Figure 3:
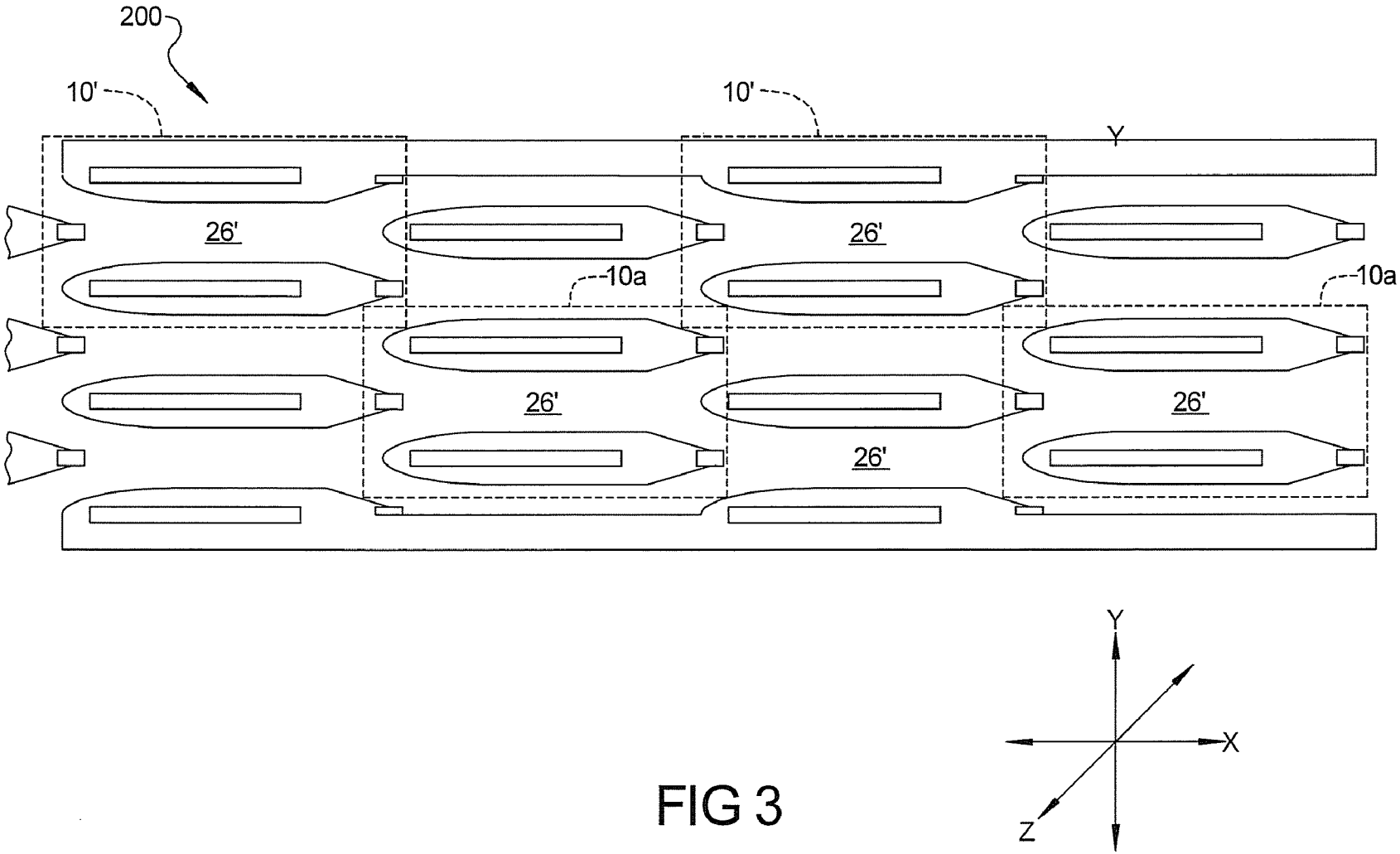
FIG. 3 is a cut through a three-dimensional fluid flow accelerating system using a plurality of the fluid flow accelerating devices shown in FIG. 1.

Referring to FIG. 3, a three dimensional flow accelerating system 200 is shown. System 200 forms, for example, a four stage, three pump system similar to system 100 but includes additional apparatuses 10' that may be laterally offset from apparatuses 10'. By "laterally offset" it is meant that apparatuses 10*a*, for example, may be located at a different position along the Z plane than apparatuses 10'. Thus, a three dimensional plurality of flow paths 26' may be created. The offset arrangement allows more efficient packing of actuator stages in a smaller volume and length.

Figure 4:
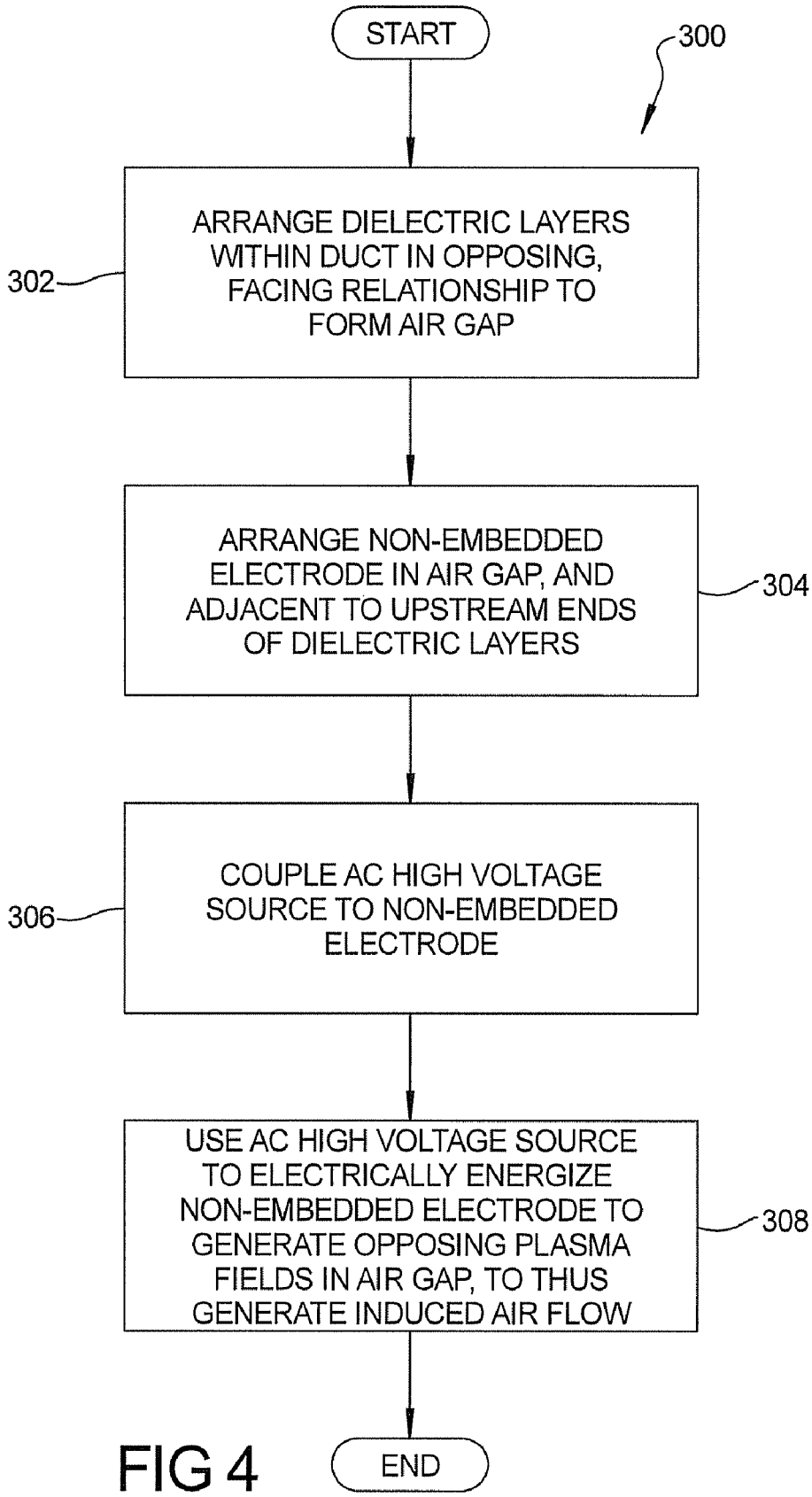
FIG. 4 is a flowchart of the operations of forming a system such as that shown in FIG. 1.

FIG. 4 is a flowchart 300 illustrating a method for forming a flow accelerating system, such as system 14, using a dielectric barrier discharge pump, such as apparatus 10. At operation 302 dielectric layers are arranged within a duct with each layer having its own embedded electrode, so as to form an air gap therebetween. At operation 304 a non-embedded electrode is arranged adjacent to upstream ends of the embedded electrode. At operation 306 a high voltage AC voltage source is coupled to the non-embedded electrode. At operation 308 the non-embedded electrode is electrically energized to cause opposing, asymmetric plasma fields to be generated in the air gap. The plasma fields cause an induced air flow in the air gap that serves to accelerate a fluid flowing through the duct.

The various embodiments described herein all form a means to accelerate a fluid flow without the need for devices having moving parts. The various embodiments disclosed herein thus enable even more reliable, lighter weight, and potentially less costly flow accelerating systems to be implemented than what would be possible with previously developed pumps that require moving parts for their operation.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A dielectric element barrier discharge pump for accelerating a fluid flow within a duct, comprising:

a dielectric layer having a first electrode embedded therein;

a third electrode upstream of said first electrode relative to a direction of flow of fluid flow, and further being supported apart from the dielectric layer so as to form a gap therebetween;

a high voltage source for supplying a high voltage signal to the third electrode;

a second electrode positioned at least partially within an additional dielectric layer, and being generally longitudinally aligned with said first electrode within said duct, and further such that the additional dielectric layer is supported apart and downstream of the second electrode so as to form an additional gap between the third electrode and the second electrode;

said third electrode cooperating with said first and second electrodes to generate a plasma field in said gap that creates an induced air flow within said gap between the first and third electrodes, said induced air flow accelerating said fluid flow as said fluid flow moves through said gap.

2. The pump of claim 1, wherein said plasma field comprises an asymmetrically accelerating plasma field.

3. The pump of claim 1, further comprising a ground plane electrically coupled to said first and second electrodes.

4. The pump of claim 1, wherein said high voltage source comprises an alternating current high voltage source of between approximately 1KVAC-100KVAC.

5. The pump of claim 1, wherein said air gap forms a distance of between about 0.1 inch-1.0 inch.

6. The pump of claim 1, further comprising a fourth electrode disposed in said dielectric layer, and a fifth electrode embedded in said additional dielectric layer and longitudinally spaced apart from said second electrode, an additional gap being formed between said fourth and fifth electrodes longitudinally downstream of said gap;

a sixth electrode disposed at least partially within said additional gap;

said fourth, fifth and sixth electrodes adapted to be electrically excited by said alternating current voltage source to form additional, opposing plasma fields between said fourth and fifth electrodes, to create an additional induced fluid flow, to thus further accelerate said fluid flow as said fluid flow flows through said additional gap.

7. The pump of claim 1, where both of said dielectric layer and said additional dielectric layer are disposed on a pair of generally parallel, spaced apart surfaces of said duct.

8. A flow accelerating system for accelerating a fluid flow through a confined area, said apparatus comprising:

a first flow accelerating apparatus including:

a first dielectric layer having a first electrode embedded therein;

a second dielectric layer having a second electrode embedded therein, the first and second dielectrics further being supported apart from one another such that the first and second dielectric layers are configured in generally facing relationship, and such that an air gap is formed between the first and second dielectric layers;

a third electrode disposed at least partially in said air gap, upstream of said first and second electrodes relative to a direction of flow of said fluid flow, and arranged along a longitudinal axis extending coaxially with an axial center of said duct;

a high voltage source for supplying a high voltage signal to said third electrode; and said third electrode, said first electrode and said second electrode adapted to generate opposing asymmetric plasma fields in said air gap, in response to the application of said high voltage signal to said third electrode, that create an induced air flow within said air gap, said induced air flow adapted to accelerate said fluid flow as said fluid flow moves through said air gap;

a second flow accelerating apparatus disposed downstream of said first flow accelerating apparatus, adapted to further accelerate said fluid flow after said fluid flow has moved past said first flow accelerating apparatus.

9. The system of claim 8, wherein said second flow accelerating apparatus includes:

a fourth electrode embedded in said first dielectric layer, and longitudinally spaced apart from said first electrode;

a fifth electrode embedded in said second dielectric layer and longitudinally spaced apart from said second electrode, an additional air gap being formed between said fourth and fifth electrodes longitudinally downstream of said air gap;

a sixth electrode disposed at least partially within said additional air gap;

said fourth, fifth and sixth electrodes adapted to be electrically excited by said alternating current voltage source to form additional, opposing plasma fields between said fourth and fifth electrodes, to create an additional induced fluid flow, to thus further accelerate said fluid flow as said fluid flow flows through said additional air gap.

10. The system of claim 8, further comprising a controller for controlling the operation of said high voltage source.

11. The system of claim 8, wherein:

said third electrode is disposed completely within said air gap; and said sixth electrode is disposed completely within said additional air gap.

12. The system of claim 8, wherein said alternating current (AC) voltage source comprises an AC voltage source generating about 1000 volts to about 100,000 volts.

13. A method of forming a fluid flow pump for accelerating a fluid through a duct, said method comprising:

disposing a first electrode at least partially within a first dielectric layer;

disposing said first dielectric layer within said duct;

disposing a second electrode at least partially within a second dielectric layer;

disposing said second dielectric layer within said duct so as to be in generally facing relation to said first dielectric layer, and such that an air gap is formed between said first and second dielectric layers;

positioning a third electrode within said duct such that said third electrode is located at least partially within said air gap and towards an upstream end of said dielectric layers, relative to a direction of flow of said fluid through said air gap, and further such that said third electrode is aligned along a longitudinal axis that is generally coaxial with an axial center of said duct;

electrically exciting said third electrode to cause said third electrode, said first electrode and said second electrode to cooperatively generate opposing, asymmetric electrical fields within said air gap, to thus generate an induced flow through said air gap, said induced flow operating to accelerate said fluid as said fluid flows through said air gap.

14. The method of claim 13, further comprising locating said third electrode completely within said air gap.

15. The method of claim 13, wherein electrically exciting said third electrode comprises electrically exciting said third electrode with an alternating current voltage within the range of about 1KVAC-100KVAC.

16. The method of claim 15, further comprising forming an additional fluid flow pump within said duct at a location downstream, relative to a direction of flow of said fluid, of said fluid flow pump.

17. A flow accelerating system for accelerating a fluid flow through a confined area, said apparatus comprising:

a first flow accelerating apparatus including:

a first dielectric layer having a first electrode embedded therein;

a second dielectric layer having a second electrode embedded therein, the first and second dielectrics further being supported apart from one another to form an air gap therebetween;

a third electrode disposed at least partially in said air gap, upstream of said first and second electrodes relative to a direction of flow of said fluid flow;

a high voltage source for supplying a high voltage signal to said third electrode; and said third electrode, said first electrode and said second electrode adapted to generate opposing asymmetric plasma fields in said air gap, in response to the application of said high voltage signal to said third electrode, that create an induced air flow within said air gap, said induced air flow adapted to accelerate said fluid flow as said fluid flow moves through said air gap;

a second flow accelerating apparatus disposed downstream of said first flow accelerating apparatus, adapted to further accelerate said fluid flow after said fluid flow has moved past said first flow accelerating apparatus;

a third flow accelerating apparatus positioned so as to be laterally offset from said first and second flow accelerating apparatuses, to thus form a two-dimensional flow accelerating system; and a fourth flow accelerating apparatus positioned so as to be laterally offset from all of said first, second and third flow accelerating apparatuses, to thus form a three-dimensional flow accelerating system.

* * * * *